United States Patent [19]

Gauthier

[11] Patent Number: 4,682,478

[45] Date of Patent: Jul. 28, 1987

[54] DEVICE FOR MAKING A NEW TYPE OF YARN

[75] Inventor: Gilbert Gauthier, Loire, France

[73] Assignee: Moulinages Henri Lacroix, France

[21] Appl. No.: 721,922

[22] Filed: Apr. 11, 1985

[30] Foreign Application Priority Data

Apr. 24, 1984 [FR] France ..... 84 06620

[51] Int. Cl.[4] ..... D04B 31/02

[52] U.S. Cl. ..... 66/81; 66/125 R

[58] Field of Search ..... 66/1 R, 9 A, 79, 80, 66/81, 125 R, 169 R, 8

[56] References Cited

U.S. PATENT DOCUMENTS

| | | | |
|---|---|---|---|
| 956,820 | 5/1910 | Nicholls | 66/81 |
| 2,020,197 | 11/1935 | Meiwald | 66/169 R X |
| 2,108,705 | 2/1938 | Broadwin | 66/8 |
| 2,129,393 | 9/1938 | Woolhiser | 66/79 |
| 2,348,746 | 5/1944 | Nardulli | 66/1 R |
| 2,656,690 | 10/1953 | Buxbaum et al. | 66/8 |
| 3,748,874 | 7/1973 | Blezard | 66/1 R X |
| 3,939,671 | 2/1976 | Lawson et al. | 66/125 R X |

FOREIGN PATENT DOCUMENTS

| | | | |
|---|---|---|---|
| 32530 | 1/1885 | Fed. Rep. of Germany | 66/9 A |
| 2426102 | 2/1979 | France . | |
| 592765 | 11/1977 | Switzerland | 66/9 A |
| 3704 | of 1892 | United Kingdom | 66/79 |
| 1488458 | 10/1977 | United Kingdom . | |

*Primary Examiner*—Wm. Carter Reynolds

*Attorney, Agent, or Firm*—Parkhurst & Oliff

[57] ABSTRACT

A device for obtaining novelty yarns from at least two elementary yarns connected to each other by chain stitches constituted by at least one of the yarns. The device has a rotatable hollow spindle which passes the yarn made. The spindle supports and rotates at least one knitting needle. At least one of the elementary yarns is introduced into the nose of the needle during rotation of the spindle. An assembly is used to cast off the stitches formed on the needle and to guide the novelty yarn obtained thereby inside the internal channel of the hollow spindle.

3 Claims, 10 Drawing Figures

DEVICE FOR MAKING A NEW TYPE OF YARN

BACKGROUND OF THE INVENTION

A. Field of the Invention

The present invention relates to a device for obtaining a new type of novelty yarn and the yarns thus obtained.

The invention relates more particularly to an improved device for obtaining, from at least two yarns, both novelty yarns presenting localized effects such as flames and buttons, loops, and novelty yarns presenting effects of color and/or yarns in which one of the two constituents forms a core covered entirely by the other constituent.

B. Description of the Prior Art

Numerous techniques have been proposed for making novelty yarns. Concerning those presenting localized effects over their length (i.e. flames, buttons and loops), the most wide-spread technique consists in winding at least one effect yarn about a core yarn, for example by using a twister comprising a plurality of pairs of delivery rolls or an uptwister with hollow spindle possibly equipped with a false twist means. By varying the flow-rate of the effect yarn with respect to the core yarn and/or the speed of wind and/or by using a wrapping needle, it is possible to obtain a large variety of novelty yarns. However, this technique presents numerous drawbacks, the major ones being, on the one hand, a low speed of production and, on the other hand, the necessity of using an additional bonding yarn in order to stabilize the effects.

To increase the speeds of production, it has been proposed to assemble core and effect yarns by false twist, possibly subjecting them to a heat treatment before and/or after passage in the false twist member. With this technique, it is desired to obtain stable effects which do not slide on the core yarn, it is also necessary to use a bonding yarn.

Apart from the novelty yarns which present localized effects, it has also been proposed to make so-called core spun yarns in which one of the constituents, generally constituted by a multi-filament yarn, is entirely covered over the whole of its periphery by a second constituent generally constituted by discontinuous fibers. In the following description, this type of yarn will also be designated by the term novelty yarns. Such core-spun novelty yarns are generally obtained on ring spinning frames, the core being introduced in the rove of fibers upstream of the last pair of rolls of the train drafting the fibrous rove. According to this technique, the speed of production is also low and in particular, the range of yarns which may be made is limited.

Finally, it has been envisaged, in No. FR-A-2 426 102, to make novelty yarns comprising a core yarn and an effect yarn in which the effect yarn is attached to the core spun yarn by chain stitches formed by the core spun yarn itself. According to this document, although it is not clear from the description, the technique used to make such a yarn requires the use of a warp knitting machine comprising at least two guide bars, one of the bars forming chain stitches and the other working in weft so as to form the effects. The weave of the two bars may possibly be reversed so that the two yarns alternately form chain stitches and wefts.

In such a type of spun yarn, the effects are bonded well by the chain stitches, but it should be noted that it requires the use of expensive equipment which is delicate to operate and which lacks versatility. Moreover, winding of the yarns formed involves either the transformation of this loom to wind each of the yarns individually, or, if the yarns are wound on a common support tube, a complementary operation to place them on the individual supports.

Other solutions employing knitting machines or the like have been proposed for making the yarns, as disclosed in No. CH-A-592 765, No. GB-A-1 488 458 and No. FR-A-2 329 779. These solutions, like those forming the subject matter of No. FR-A-2 426 102 mentioned above, lack versatility and generally enable only one type of yarn to be obtained.

SUMMARY OF THE INVENTION

Now, a device of particularly simple design and easy to operate, has been found, and this is what forms the subject matter of the present invention. The present invention makes it possible to produce not only novelty yarns presenting localized effects, but also novelty core spun yarns, and this from materials which may have different characteristics.

BRIEF DESCRIPTION OF THE DRAWINGS

The invention will be more readily understood on reading the following description with reference to the accompanying drawings, in which.

DETAILED DESCRIPTION OF THE INVENTION

The invention therefore generally relates to a device for obtaining novelty yarns from at least two elementary yarns, said elementary yarns being connected to each other by chain stitches constituted by at least one of the two yarns. The device according to the invention is characterized in that it comprises, mounted on a common support disposed between the source of supply of the elementary yarns and the means for winding the novelty yarn formed:

a rotatable hollow spindle inside which passes the yarn made, said spindle supporting and rotating at least one knitting needle;

means for presenting at least one of the elementary yarns in the nose of the needle during rotation of said spindle;

a fixed assembly for casting off the stitches formed on the needle and guiding the novelty yarn obtained inside the internal channel of the hollow spindle.

Furthermore, the device according to the invention comprises, in known manner, upstream and downstream, means for compensating the tension of the yarns and for detection of breaks.

According to a preferred embodiment, the means for presenting at least one of the yarns in the nose of the needle during rotation of the spindle are in the form of guides adapted to be actuated selectively so as to present at least one of the yarns or all of the yarns inside the nose of the needle. In one embodiment, these guides are in the form of a moveable presentation assembly. The device may possibly also be associated with an assembly comprising a cutter and a clamp making it possible to deliver one of the constituents in intermittent manner through the stitches formed by the other constituent.

Thanks to such a device, it is possible to obtain a new type of novelty yarns which may both present stable protuberances blocked over their length, the size of these protuberances being able to vary within wide limits, and this without addition of a bonding yarn, and make novelty yarns comprising an inner core regularly covered by a second constituent, the cover being perfectly stable around said core.

The device according to the invention may be used for working yarns of any nature, whether they be with continuous filament or based on discontinuous fibers, these yarns possibly having received complementary treatments, for example a prior treatment of texturing by false twist.

Moreover, the novelty yarn made according to the invention may be used as such without it being necessary to communicate thereto an additional twist or, as a function of the uses envisaged, it may receive such a twist.

Figure 1:
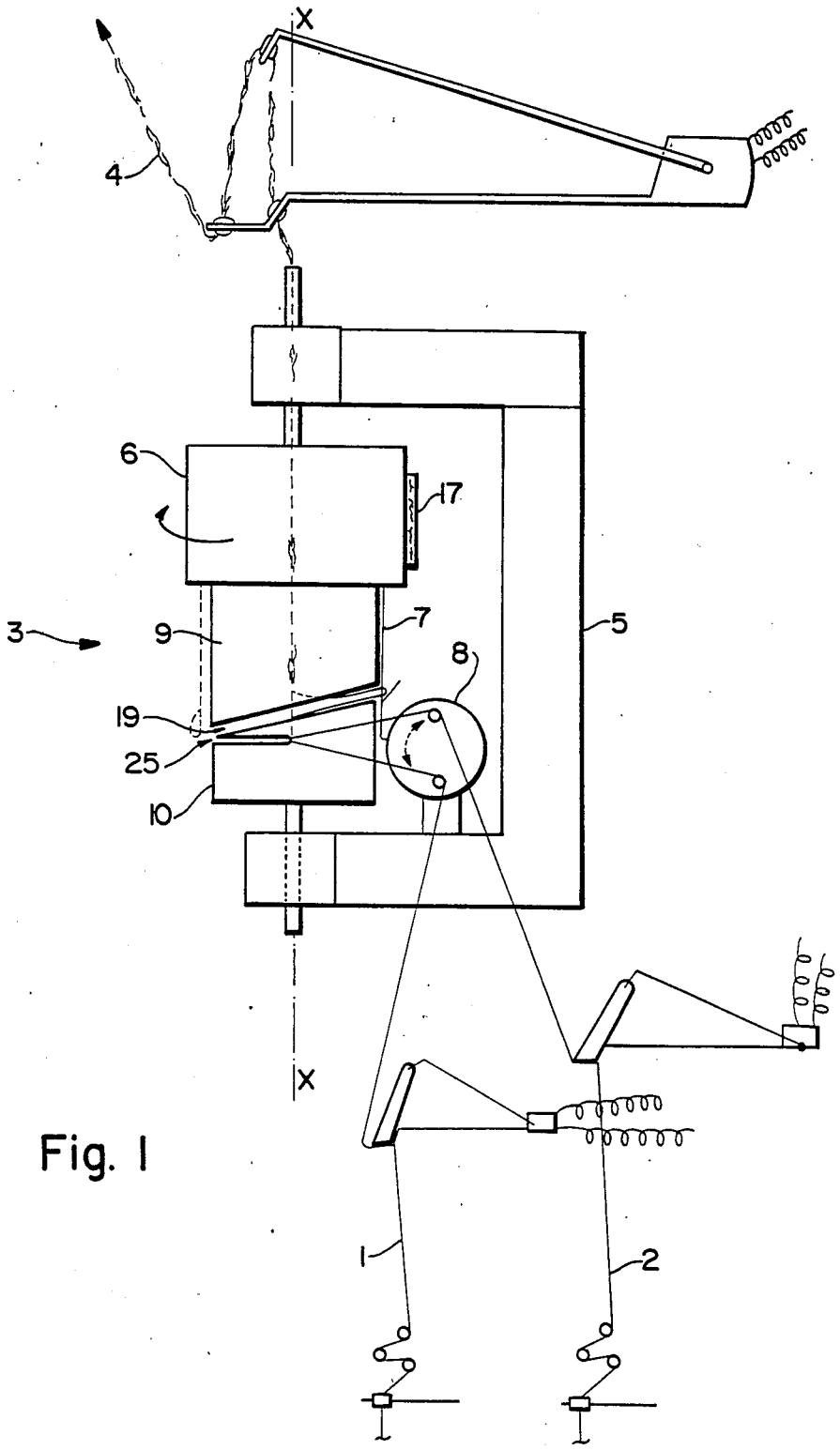
FIG. 1 illustrates the skeleton diagram of an installation for making a novelty yarn equipped with a device according to the invention.

Referring now to the drawings, and more particularly to FIG. 1, the device according to the invention for making novelty yarns from at least two elementary yarns 1, 2 is composed of an assembly, generally designated by reference 3, disposed between the source of supply of the elementary yarns 1, 2 and the member for receiving the novelty yarn 4 formed. As supply and reception are conventional, they have not been shown and will not be described, in order to simplify the present description. The assembly 3 according to the invention for combining the elementary yarns 1, 2 with a view to forming the novelty yarn 4 comprises, mounted on a common support 5, fixed on the frame of the machine, a rotatable hollow spindle 6 whose structure and operation is clearly apparent in FIG. 1. At least one conventional knitting needle 7, in the present case a latch needle, is mounted fixed on this spindle 6.

The device also comprises means 8 for presenting one and/or the other of the elementary yarns 1, 2 in the nose of the needle 7 during rotation of the spindle 6.

Moreover, a fixed assembly 9, 10 makes it possible to cast off the stitches formed on the needle 7 and guide the novelty yarn obtained inside the inner channel of the hollow spindle 6. The structure and operation of such an assembly are clearly apparent in detailed FIGS. 2 and 3, the different elementary pieces constituting such a device being illustrated in FIGS. 4 to 9.

The rotatable spindle 6 serving as support for the needle 7 is essentially constituted by a roller (cf. FIGS. 4 and 5) mounted on a bush 11 (cf. FIG. 6) comprising two roller bearings 12, 13. The assembly is blocked by means of a nut 14. The needle 7 is fixed in the roller 6 by an appropriate means, for example by blocking its heel by means of a key system 15 (FIG. 7) immobilized by a fixed nut 16. In the present case, the rotatable spindle 6 supports a single needle 7 but a plurality of needles may of course be provided on this spindle, these needles being regularly spaced apart. The needle-holder 6 (or spindle) is driven for example via a tangential belt 17.

On the fixed axis X of the rotatable spindle 6 is disposed a fixed assembly 9, 10 for casting off the stitches furnished on the needle as well as guiding the novelty yarn obtained inside inner channel in tube 18. This fixed assembly is constituted by two cams 9, 10 defining therebetween a passage 19 having a precise section which is clearly visible in FIG. 2. The structure of these two cams is clearly seen in FIGS. 6 and 9.

The so-called main cam 9 is mounted at the end of a tube 18 forming the channel proper for passage of the yarn. This cam 9/tube 18 assembly may be made either of two elementary pieces assembled together or in one piece.

The tube 18 is fixed, for example by means of a screw 20, on the arm 21 of the support 5.

The second cam 10, called counter-cam, is disposed opposite the main cam 9 and is mounted, likewise in fixed manner, on the lower arm 22 of the support 5.

Figure 9:
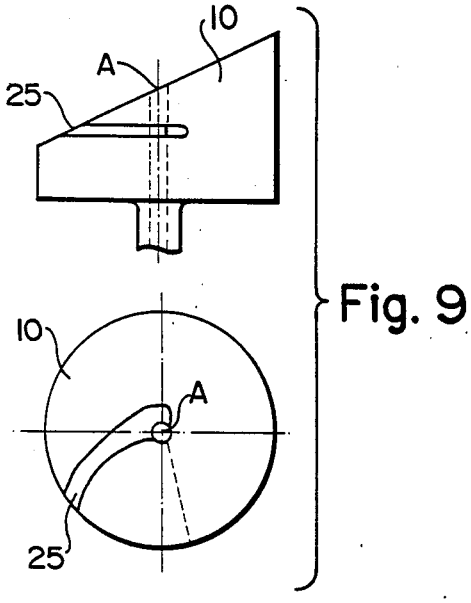
FIGS. 4 to 9 are views in detail showing the different pieces constituting a device according to the invention.

The structure of this counter-cam is illustrated in FIG. 9. It is mounted on the arm 22 via a shaft 23 immobilized by means of a screw 24. Thanks to such an assembly of the cams 9 and 10, it is possible to vary the spacing 19 between the two sections of cam 9, 10 by sliding tube 18 and shaft 25 in their housing. Furthermore, the shaft 23 may possibly be hollow to allow passage either of one of the two yarns used which will then serve as core or possibly of a third yarn on which the stitches made will wind and thus form a wrapping therearound.

Furthermore, the counter-cam 10 comprises a groove 25 adapted to guide and maintain the yarns taken by the needle and to form a loop for forming the stitch. The shape of this groove 25 is such that it allows the yarns to be retained during rotation of the needle(s).

Finally, the device according to the invention comprises means 8 for presenting one and/or the other of the elementary yarns 1, 2 in the nose of the needle 7 during rotation of the spindle 6.

Figure 3:
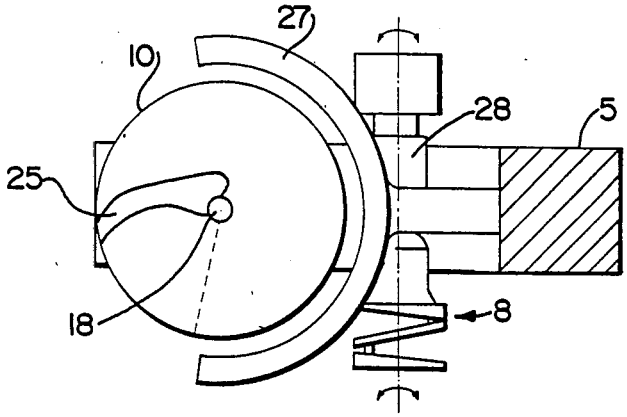
FIG. 3 is a view in section along line III—III of FIG. 2.
Figure 8:
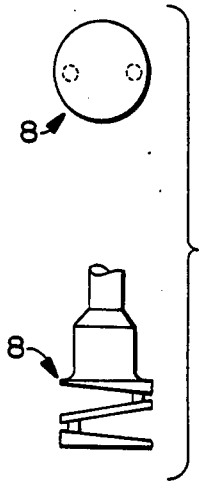
Figure 5:
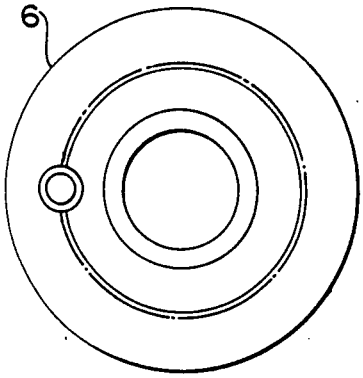
Figure 4:
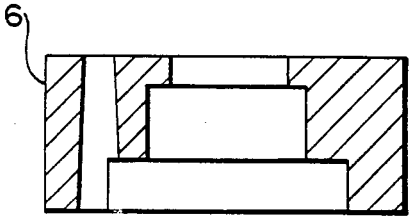
Figure 7:
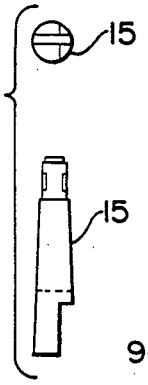
Figure 6:
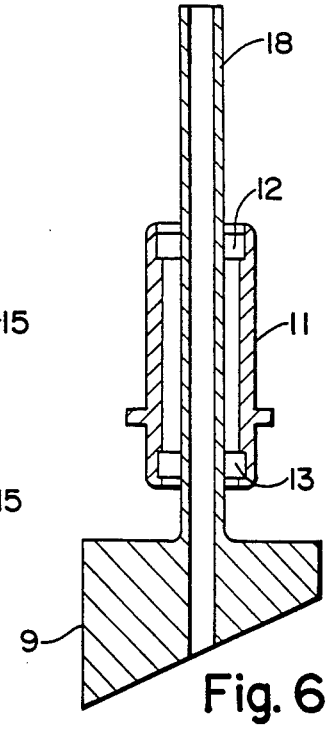

This assembly is constituted, in the present case, and as is shown more particularly in FIG. 3 and FIG. 8, by a moveable presentation assembly. This assembly 8 is mounted on a support 28 which is associated with means for pivoting it at a determined frequency. It makes it possible to modify the position of presentation of the elementary yarns 1, 2 with respect to the plane in which the end of the needle 7 moves.

Thus, in the position shown in FIG. 1, the yarn 2 is positioned above the plane of passage of the end of the needles whilst the yarn 1 is disposed below. Consequently, the needle 7 will be supplied only with yarn 2, yarn 1 passing below said needle.

Figure 2:
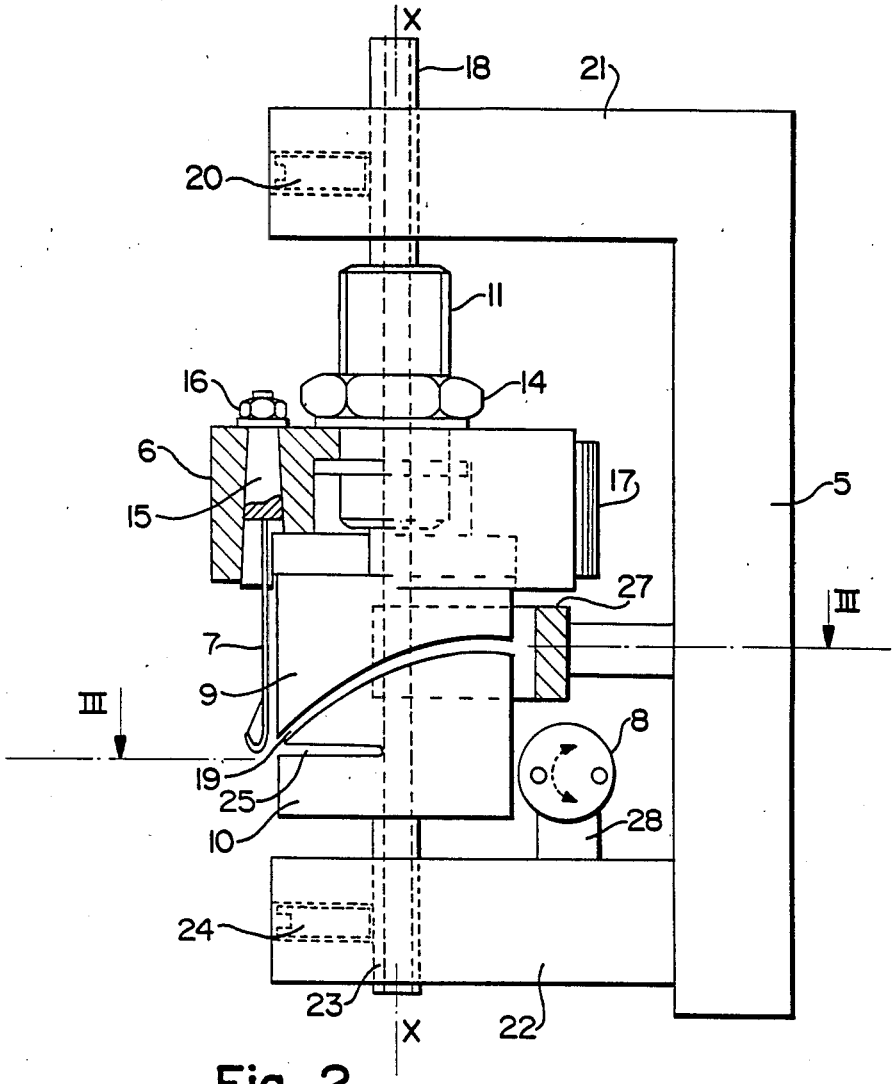
FIG. 2 is a detailed view in elevation showing the main elements of a device according to the invention, this view being shown partly in section.

On the other hand, when the assembly 8 comes into the position illustrated in FIG. 2, i.e. when the two yarns 1 and 2 are presented in the same plane, the two yarns will be taken by the nose of the needle.

By reversing the position of the assembly 8 with respect to FIG. 1, it will be possible for the needle to take yarn 1 and for yarn 2 to escape.

Of course, as shown in FIG. 1, conventional tension compensating means and break detectors are provided both for the elementary yarns 1, 2 and for the novelty yarn 4 formed. Such means are well known to the man skilled in the art, and they will therefore not be described.

Such a device operates as follows:

The two elementary yarns 1, 2 coming froma source of supply (not shown), after passage over tensioning means, are brought onto the moveable presentation assembly 8 which, as a function of its position, presents one or the other yarn (or the two together) to the needle 7. In the event of the moveable presentation assembly 8 being in the position shown in FIG. 1, the yarn 2 is disposed above the plane of rotation of the needle 7, whilst yarn 1 is disposed below. The two yarns then pass into the guide slot 25 provided in the counter-cam 10. FIG. 9 shows a side view and top view, respectively, of the counter-cam 10 and guide slot 25, with the aforementioned hollow portion of the hollow spindle designated by the letter A for reference purposes. During rotation of the spindle 6, the needle 7, whose latch was previously opened, for example by means of a semicircular magnet 27 acting on the latch after casting off, receives the yarn 2. Upon each revolution, a stitch is therefore formed which makes it possible to assemble the two yarns together which are extracted in order to be brought to the winding member through the inner channel in tube 18.

More specifically, the rotatable spindle 6 causes the needle 7, attached thereto, to rotate around fixed assembly 9,10, thereby picking up either yarn 1 or 2, or both, depending upon the position of the presentation assembly 8. The yarn above the plane of rotation of the needle hook will be picked up by the needle hook and formed into a loop by the rotation of needle 7, via rotatable spindle 6, around the fixed assembly 9,10. The inclined opposed faces of the main cam 9 and counter-cam 10, forming passage 19, and groove 25 on counter-cam 10, cause a formed loop to rise above the latch of needle 7 and then to fall down over the closed latch thereby casting-off the formed loop from the needle 7. Prior to the closing of the latch of needle 7, the needle hook again picks up yarn 1 or 2, or both, to begin forming a new loop, which is then brought up through the previously formed loop prior to cast off of the newly formed loop by the opposed inclined surfaces of cams 9 and 10.

Thanks to such a device, it is possible to obtain a large number of different yarns both by their composition and by the effects that they present. Embodiments of some of these types of yarn will be given hereinafter by way of example.

EXAMPLE 1

On a device according to the invention, of the type illustrated in FIGS. 2 and 3, wherein the Figures are substantially to scale I, a novelty yarn is made from two elementary yarns 1, 2:

yarn 1 is a blue yarn, based on cotton, having a count of 500 decitex;

yarn 2 is a white yarn, based on acrylic, having a count of 660 decitex.

The device according to the invention is adjusted so that the moveable presentation assembly 8 is in the position shown in FIG. 1, i.e. only yarn 2 will be deposited in the nose of the needle 7, yarn 1 permanently escaping this needle. In the present case, one needle 7 only is mounted on the rotatable spindle 6. The intake speed of the novelty yarn 4 formed is adjusted to 120 m/min and the speed of rotation of the spindle 6 to about 1000 r.p.m.

By working in this manner, a novelty yarn is obtained presenting a blue and white chine effect, the blue yarn being imprisoned in substantially rectilinear manner inside the stitches formed by the white yarn which for their part are drafted strongly.

Such a yarn may be used as such in weaving or knitting and produces articles with chine appearance.

EXAMPLE 2

On the same device as hereinbefore, equipped with one needle only and operating at the same speed, two yarns 1, 2 are supplied, one constituted by a nylon yarn of 22 dtex, the other by an acrylic yarn of 500 decitex.

In operation, the moveable presentation assembly 8 is adjusted so that its position is modified by intermittence in order that the nylon yarn be taken by the needle upon each revolution of the spindle 6, whilst the acrylic yarn is taken only intermittently. To obtain this result, the moveable presentation assembly 8 is placed either in the position shown in FIG. 1, or in that shown in FIG. 2.

A novelty yarn is obtained, presenting over its length flamed parts in excess thickness constituted by an imbrication of stitches when the two yarns are taken simultaneously by needle 7, these flamed parts being separated by zones in which only the nylon yarn forms stitches, which gives the acrylic yarn therebetween.

EXAMPLE 3

A novelty yarn is obtained by equipping the rotatable spindle 6 with four needles 7 regularly spaced on said spindle. The device is supplied with two yarns 1, 2 of the same nature, namely acrylic yarns having a count of 500 decitex.

The moveable presentation assembly 8 is actuated so that, at variable intervals of time, the needles take either yarn 1 or yarn 2 or both yarns together.

A novelty yarn is obtained presenting flames of more or less large size, separated from one another by thin portions.

As for the preceding yarns, the effects are particularly stable, and they may be used directly either in weaving or in knitting.

The foregoing examples clearly show the large variety of yarns which may be obtained when using the device according to the invention.

In all cases, the effects formed are perfectly stable.

The invention is, of course, not limited to the embodiments given hereinbefore, but it covers all the variants thereof made in the same spirit.

Figure 10:
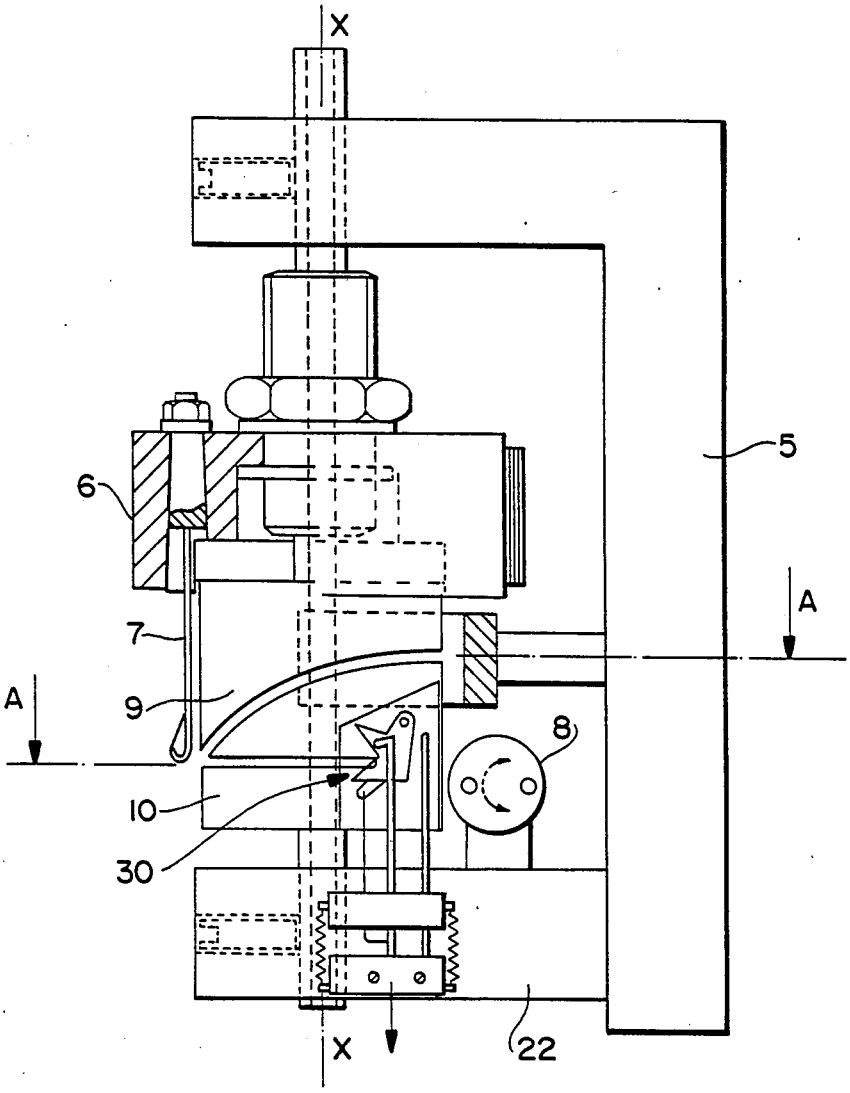
FIG. 10 illustrates a variant of a device according to the invention equipped with a yarn cutting member ensuring intermittent supply of one of the two constituents of a novelty yarn according to the invention.

It may for example be envisaged to associate with the device according to the invention a system 30 (cf. FIG. 10) for intermittently cutting one or the other of the yarns and which makes it possible to inject simply a length of yarns or fibers of different natures. The different fibers will be injected by means of an assembly 30 mounted inside the cam 10, and recessed with respect to the plane of rotation of the needle 7. This assembly 30 essentially comprises a cutter and a clamp whose actions are synchronized.

The operation of such an assembly is clearly apparent from Example 4 hereinafter.

EXAMPLE 4

On the same device as before, equipped with one needle only, two yarns 1, 2 are supplied, one constituted by a nylon yarn of 22 dtex, the other by an acrylic yarn of 500 dtex.

In operation, the moveable presentation assembly 8 is adjusted so that its position is modified intermittently in order that the nylon yarn be taken by the needle upon each revolution of the spindle 6. This yarn will be presented so as not to penetrate in the jaws of the cutter. On the other hand, the acrylic yarn will be taken only intermittently depending on the position of the assembly 8 which will be synchronized with the cutter so that, when the acyrlic yarn is lowered to escape being taken by the needle, the cutter cuts it and at the same time the clamp retains it, thus preventing it from leaving the field of passage of the needle to enable it, when the assembly 8 presents the acrylic yarn for grip by the needle, to start off again with the chain stitches.

When the acrylic yarn rises, the cutter opens and releases the acrylic yarn which resumes its cycle with the nylon to form a flame.

In this variant, the needle must be synchronized with the cutter and the assembly 8 in order to avoid having, at the end of a flame, a yarn end which is not imprisoned in the chain stitch.

A novelty yarn is thus obtained, comprising a nylon yarn of 22 dtex in the form of a chain stitch which periodically contains, as a function of the adjustments, flames constituted by the acrylic fibers.

The foregoing description and example clearly show the advantages brought by the invention and the large varieties of types of yarns which such a device can produce. It should also be noted that the means for presenting one or each yarn to the needle will be controlled by an appropriate means but it will preferably be carried out via a programmable electronic system. Moreover, the device according to the invention may be used for making core-spun yarns comprising a perfectly rectilinear inner core covered with a homogeneous sheath. In such a case, it suffices to bring an additional yarn in the shaft of the spindle, this yarn being covered by the yarns presented to the needles supported by said spindle.

Finally, although in the examples given hereinabove the novelty yarns produced are obtained from elementary yarns, it may be envisaged to deliver more than two yarns to the device according to the invention, at least one of these yarns forming stitches.

What is claimed is:

1. A device for obtaining novelty yarns from at least two elementary yarns, said elementary yarns being connected to each other by a chain of stitches constituted by at least one of the two yarns, comprising, mounted on a common support disposed between the source of supply of the elementary yarns and the means for winding the novelty yarn formed:

a rotatable hollow spindle having an internal channel inside which passes the yarn made, said spindle supporting and rotating at least one knitting needle, said needle comprising a nose which is always in the same plane during the rotation of said spindle;

means for presenting at least one of the elementary yarns in the nose of the needle during the rotation of said spindle;

a fixed assembly for casting off stitches formed on said needle and guiding the novelty yarn obtained inside the internal channel of the hollow spindle.

2. The device of claim 1, wherein said means for presenting at least one of the yarns in the nose of the needle during rotation of the spindle are in the form of guides adapted to be actuated selectively so as to present at least one of the yarns inside the nose of the needle.

3. The device of claim 2, wherein said guides are in the form of a moveable presentation assembly.

* * * * *